US010454197B1

(12) United States Patent
Ruffini et al.

(10) Patent No.: US 10,454,197 B1
(45) Date of Patent: Oct. 22, 2019

(54) ELECTRICAL CONNECTOR WITH PLASTIC LATCH INTEGRATED INTO CONTACT CAVITY

(71) Applicant: TE CONNECTIVITY CORPORATION, Berwyn, PA (US)

(72) Inventors: Nicholas P. Ruffini, Lancaster, PA (US); Lynn Robert Sipe, Mifflintown, PA (US); George E. Kell, Etters, PA (US); Albert Tsang, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/142,533

(22) Filed: Sep. 26, 2018

(51) Int. Cl.

| | |
|---|---|
| ***H01R 13/502*** | (2006.01) |
| ***H01R 13/41*** | (2006.01) |
| *H01R 13/04* | (2006.01) |
| *H01R 107/00* | (2006.01) |
| *H01R 24/86* | (2011.01) |

(52) U.S. Cl.
CPC ..... *H01R 13/41* (2013.01); *H01R 13/04* (2013.01); *H01R 24/86* (2013.01); *H01R 2107/00* (2013.01)

(58) Field of Classification Search
CPC ..... H01R 13/426
USPC ..... 439/744, 745, 748
See application file for complete search history.

(56) References Cited

U.S. PATENT DOCUMENTS

| | | | | | |
|---|---|---|---|---|---|
| 2,419,018 | A * | 4/1947 | Gudie | H01R 13/426 | 174/21 JS |
| 3,040,287 | A * | 6/1962 | Agron | H01R 13/621 | 439/275 |
| 3,090,937 | A * | 5/1963 | Keith | H01R 13/434 | 439/745 |
| 3,177,464 | A * | 4/1965 | Solorow | H01R 13/4367 | 439/695 |
| 3,327,282 | A * | 6/1967 | Krolak | H01R 13/426 | 439/275 |
| 3,336,569 | A * | 8/1967 | Nava | H01R 13/426 | 439/589 |
| 3,588,783 | A * | 6/1971 | Newman | H01R 13/502 | 174/135 |
| 4,362,350 | A * | 12/1982 | von Harz | H01R 13/426 | 439/607.12 |
| 4,421,378 | A * | 12/1983 | Sanford | H01R 13/426 | 439/686 |
| 4,684,187 | A * | 8/1987 | Rudy, Jr. | H01R 13/424 | 439/595 |

(Continued)

*Primary Examiner* — Neil Abrams

(57) ABSTRACT

An electrical connector with an insert assembly used to retain contact in an electrical connector. The insert assembly includes a rear insert and a front insert. The rear insert has a rear insert front surface, a rear insert rear surface and a rear insert outer surface. The rear insert outer surface extends between the rear insert front surface and the rear insert rear surface. Rear insert contact-receiving openings extend from the rear insert front surface to the rear insert rear surface. Latches are provided in the rear insert outer surface and are provided in alignment with respective rear insert contact-receiving openings. The latches are integrally formed in the rear insert outer surface. The latches are positioned proximate to the rear insert contact-receiving openings thereby allowing the latches to deform into the rear insert contact-receiving openings.

20 Claims, 3 Drawing Sheets

(56) References Cited

U.S. PATENT DOCUMENTS

| | | | | |
|---|---|---|---|---|
| 7,172,467 | B1 * | 2/2007 | Yohn | H01R 13/426<br>439/686 |
| 7,591,682 | B2 * | 9/2009 | Umemura | H01R 13/426<br>439/598 |

* cited by examiner

ELECTRICAL CONNECTOR WITH PLASTIC LATCH INTEGRATED INTO CONTACT CAVITY

FIELD OF THE INVENTION

The invention is directed to an electrical connector with a plastic latch integrated into a contact cavity. In particular, the invention is directed to a one-time use plastic latch which permanently retains an insert in a shell of the electrical connector.

BACKGROUND OF THE INVENTION

Electrical connectors include various parts or components, such as, but not limited to housings, terminals and retention members. In various applications, such as for use in that aerospace or defense industries, it is often desirable or required that once the components of the connector are assembled, the components cannot be taken apart or removed. In order to ensure that the components are permanently retained in the housing, adhesive is applied to retain the components in the housing. However, the application of the adhesive is costly and adds additional steps to the manufacturing and assembly processes. In addition, the adhesive often flows from the desired area to undesirable areas, thereby effecting the reliability of both the electrical and mechanical connections, which can result in the failure of the connector.

It would, therefore, be beneficial to provide a connector in which the components can be permanently secured without the use of adhesive. In particular, it would be beneficial to provide a robust integral latch which allows for the components to be securely and permanently mounted in the connector housing.

SUMMARY OF THE INVENTION

An embodiment is directed to an electrical connector with an insert assembly used to retain contact in an electrical connector. The insert assembly includes a rear insert, a front insert and contact retention clips. The rear insert has a rear insert front surface, a rear insert rear surface and a rear insert outer surface. The rear insert outer surface extends between the rear insert front surface and the rear insert rear surface. Rear insert contact-receiving openings extend from the rear insert front surface to the rear insert rear surface. Latches are provided in the rear insert outer surface and are provided in alignment with respective rear insert contact-receiving openings. The latches are integrally formed in the rear insert outer surface. The latches are positioned proximate to the rear insert contact-receiving openings thereby allowing the latches to deform into the rear insert contact-receiving openings.

The front insert includes a front insert front surface, a front insert rear surface and a front insert outer surface. The front insert outer surface extends between the front insert front surface and the front insert rear surface. Front insert contact-receiving openings extend from the front insert front surface to the front insert rear surface. The contact retention clips are positioned in the front insert contact-receiving openings.

An embodiment is directed to an electrical connector with an insert assembly used to retain contact in an electrical connector. The insert assembly includes a rear insert and a front insert. The rear insert has a rear insert front surface, a rear insert rear surface and a rear insert outer surface. The rear insert outer surface extends between the rear insert front surface and the rear insert rear surface. Rear insert contact-receiving openings extend from the rear insert front surface to the rear insert rear surface. Latches are provided in the rear insert outer surface and are provided in alignment with respective rear insert contact-receiving openings. The latches are integrally formed in the rear insert outer surface. The latches are positioned proximate to the rear insert contact-receiving openings thereby allowing the latches to deform into the rear insert contact-receiving openings.

The front insert includes a front insert front surface, a front insert rear surface and a front insert outer surface. The front insert outer surface extends between the front insert front surface and the front insert rear surface. Front insert contact-receiving openings extend from the front insert front surface to the front insert rear surface. A circumferentially extending recess is provided in the front insert outer surface. The recess extends from the front insert front surface toward the front insert rear surface. A wall of the recess acts as a stop surface. Crush ribs are provided in the recess.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
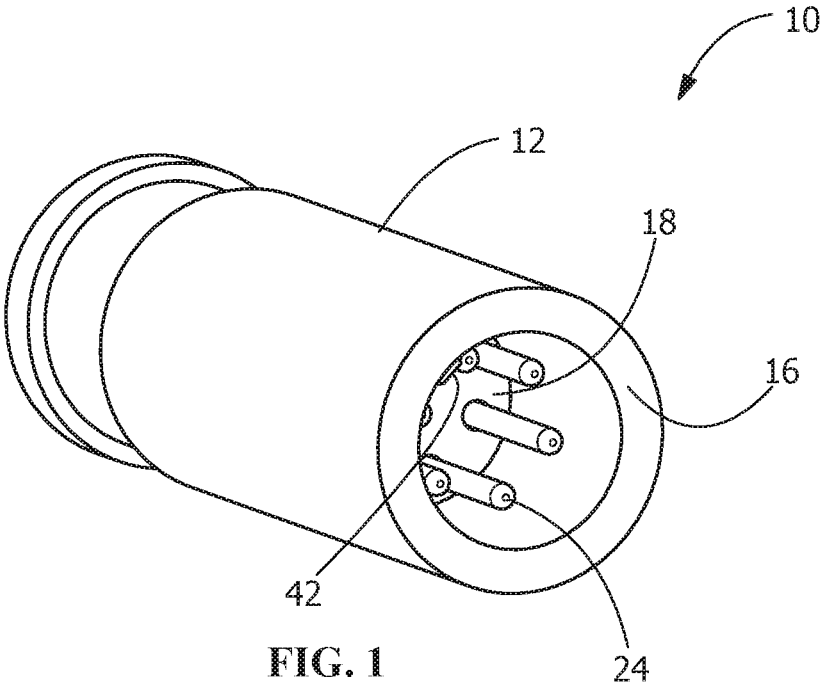
FIG. 1 is a front perspective view of an illustrative electrical connector of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 2:
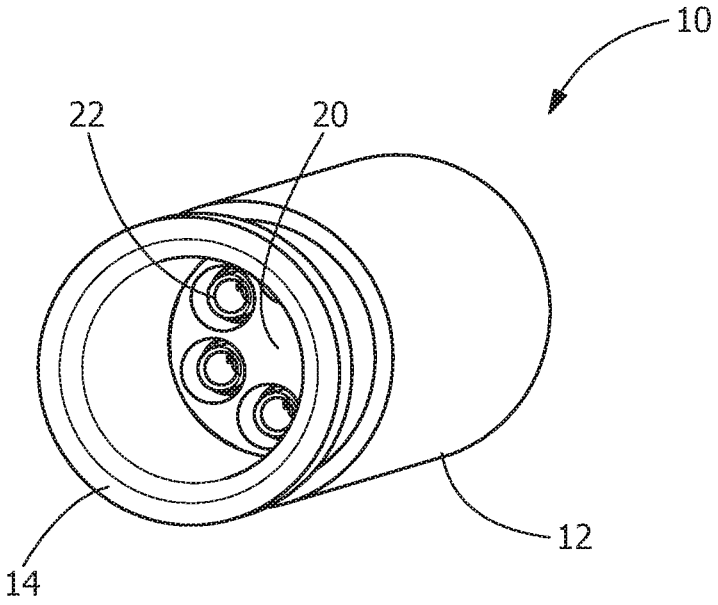
FIG. 2 is a rear perspective view of an illustrative electrical connector of FIG. 1.

Referring to FIGS. 1 and 2, an illustrative assembled electrical connector 10 is shown. The electrical connector 10 includes a shell 12 with a wire-receiving face 14 and an oppositely facing mating connector-receiving face 16. In the embodiment shown, the shell 12 is made from metal or other conductive material. However, the shell may be made from other material and have other configurations.

Figure 3:
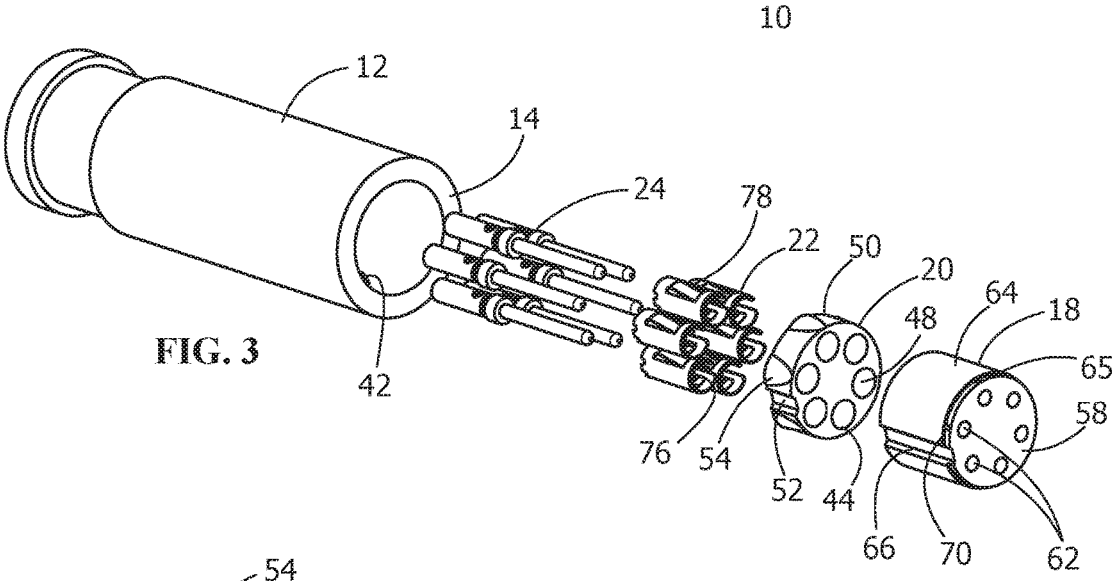
FIG. 3 is a rear exploded perspective view of an illustrative electrical connector of FIG. 1, with the components of the electrical connector shown outside of the shell of the connector.
Figure 8:
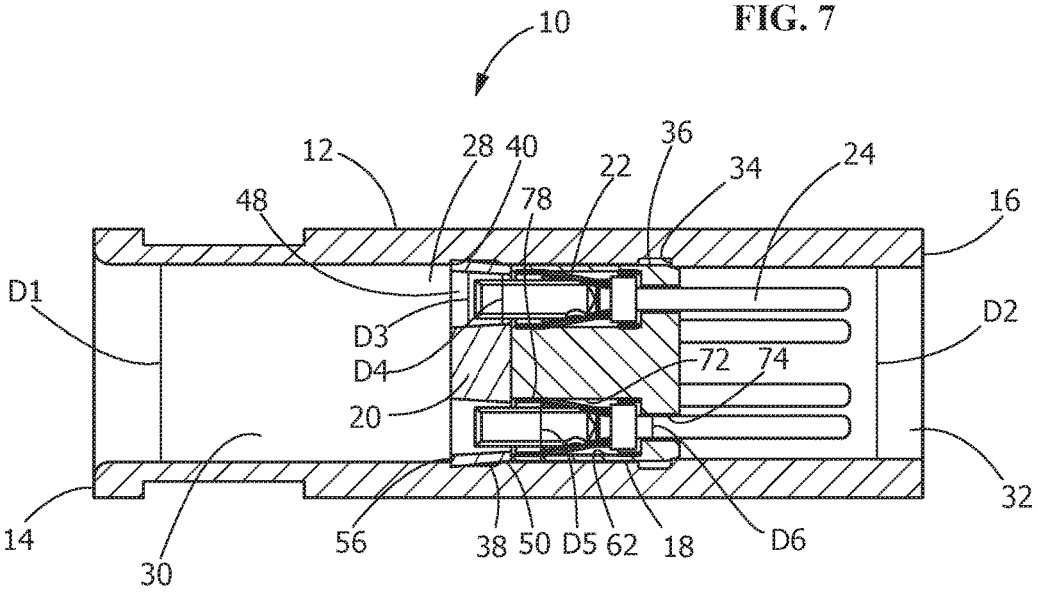
FIG. 8 is a cross-sectional view of the assembled connector of FIG. 1, taken along the longitudinal axis of the connector.

As best shown in FIGS. 3 and 8, the electrical connector, includes a front insert 18, a rear insert 20 and contact retention clips 22 into which crimped pin contacts 24 may be inserted. While crimped pin contacts 24 are shown, other type of contacts may be used without departing from the scope of the invention.

As best shown in FIG. 8, the shell 12 has an opening 28 which extends from the wire-receiving face 14 to the mating connector-receiving face 16. The opening 28 has a rear portion 30 with a diameter of D1 and a front portion 32 with a diameter of D2. The diameter D1 is larger than the diameter D2. The rear portion 30 extends from the wire-receiving face 14 toward the mating connector-receiving face 16. The front portion 32 extends from the mating connector-receiving face 16 toward the wire-receiving face 14.

A circumferentially extending stop shoulder 34 extends around the opening 28. The stop shoulder 34 is provided at intersection of the rear portion 30 and the front portion 32. A first recess 36 is provided adjacent the shoulder 34. The first recess 36 extends from the stop shoulder 34 into the rear portion 30 of the opening 28. A second or latching recess 38 is also provided in the rear portion 30 of the opening 28. The second recess 38 extends around the circumference of the opening 28 and is positioned between the first recess 36 and the wire-receiving face 14. A latching shoulder 40 is provided in the second recess 38.

An alignment projection 42 (FIG. 1) may be provided in the opening 28. The alignment projection 42 extends along the wall of the opening 28 in a direction parallel to the longitudinal axis of the of the shell 12. The alignment projection 42 may have different lengths. For example, the alignment projection 42 may extend the entire length of the shell 12 or may extend only from proximate the mating connector-receiving face 16 to proximate the second or latching recess 38.

Figure 4:
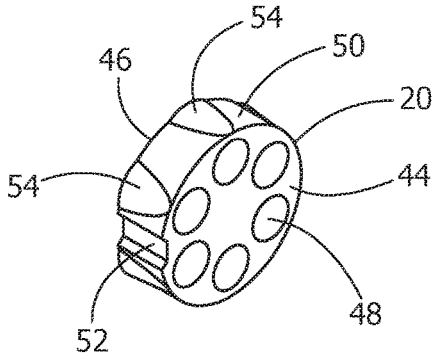
FIG. 4 is a front perspective view of an illustrative rear insert of the present invention with the latch members integrated in an outer wall of the rear insert.
Figure 5:
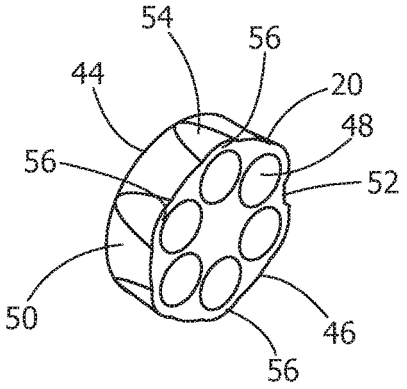
FIG. 5 is a rear perspective view of the illustrative rear insert of FIG. 4.

As best shown in FIGS. 4 and 5, the rear insert 20 has a front surface 44 and an oppositely face rear surface 46. The rear insert 20 is made of a dielectric material to electrically insulate the contacts 24 from the shell 12.

Contact-receiving openings 48 extend from the front surface 44 to the rear surface 46. In the illustrative embodiment shown, six contact-receiving openings 48 are provided, however, other numbers of contact-receiving openings can be provided. As best shown in FIG. 8, the contact-receiving openings 48 are tapered, such that the diameters D3 of the contact-receiving openings 48 proximate the rear surface face 46 are larger than the diameters D4 of the contact-receiving openings 48 proximate the front surface 44.

An outer surface 50 of the rear insert 20 extends between the front surface 44 and the rear surface 46. An alignment projection receiving recess 52 is provided in the outer surface 50. The alignment projection receiving recess 52 extends between the front surface 44 and the rear surface 46 and is dimensioned to receive the alignment projection 42 therein.

Latches 54 are provided in the outer surface 50 of the rear insert 20. In the illustrative embodiment shown, a latch 54 is provided in alignment with each contact-receiving opening 48. In alternate embodiments, the number of latches 54 may not equal the number of contact-receiving openings 48 (for example, the number of latches 54 may be less than the number of contact-receiving openings 48). The latches 54 are integrally formed in the outer surface 50 of the rear insert 20. The latches 54 are positioned proximate to the contact-receiving openings 48 which allows the latches 54 to deform into the contact-receiving openings 48, as will be more fully described.

In the illustrative embodiment shown, the latches 54 are wider proximate the rear surface 46 of the rear insert 20 and narrower proximate the front surface 44. The thickness of the latches 54 proximate the rear surface 46 of the rear insert 20 is approximately equal to the thickness of the latches 54 proximate the front surface 44, as the taper of the latches 54 conforms to the taper of the contact-receiving openings 48. However, other configurations of the latches 54 may be used. As the latches 54 are integrally molded and are part of the outside surface 50, the latches can be made of sufficient thickness to provide the strength characteristics required while providing sufficient resilient characteristics to allow the latches 54 to deflect. The spring rates of the latches 54 can be varied by controlling the thickness of the latches 54 and the height the latches 54 extend from the outside surface 50.

The latches 54 form latching shoulders 56 at the rear surface 46 of the rear insert 20. As the latching shoulders 56 are integral with the rear surface 46, the rear surface 46 and latching shoulders 56 are flush.

Figure 6:
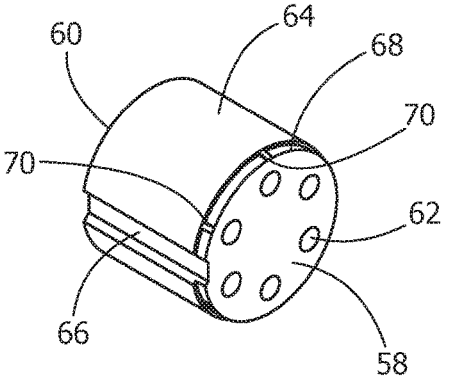
FIG. 6 is a front perspective view of an illustrative front insert of the present invention with crush ribs integrated in an outer wall of the front insert.
Figure 7:
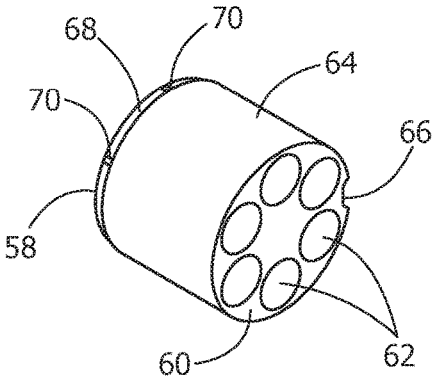
FIG. 7 is a rear perspective view of the illustrative front insert of FIG. 6.

As best shown in FIGS. 6 and 7, the front insert 18 has a front surface 58 and an oppositely face rear surface 60. Contact-receiving openings 62 extend from the front surface 58 to the rear surface 60. In the illustrative embodiment shown, six contact-receiving openings 62 are provided, however, other numbers of contact-receiving openings can be provided. The front insert 18 is made of a dielectric material to insulate the contacts 24 from the shell 12.

An outer surface 64 of the front insert 18 extends between the front surface 58 and the rear surface 60. An alignment projection receiving recess 66 is provided in the outer surface 64. The alignment projection receiving recess 66 extends between the front surface 58 and the rear surface 60 and is dimensioned to receive the alignment projection 42 therein.

A circumferentially extending cavity or recess 68 is provided in the outer surface 64 of the front insert 18. The cavity or recess 68 extends from the front surface 58 toward the rear surface 60. A wall of the cavity or recess 68 acts as a stop surface 69.

Crush ribs 70 are provided in the cavity or recess 68. In the illustrative embodiment shown, a crush rib 70 is provided in alignment with each contact-receiving opening 62. In alternate embodiments, the number of crush ribs 70 may not equal the number of contact-receiving openings 62. The crush ribs 70 are integrally formed in the cavity or recess 68 of the front insert 18.

In the illustrative embodiment shown, the crush ribs 70 have a generally uniform width and a tapered thickness, with the portion proximate the front surface 58 being thinner than the portion spaced from the front surface 58. However, other configurations of the crush ribs 70 may be used.

As best shown in FIG. 8, the contact-receiving openings 62 have rear portions 72 with diameters of D5 and front portions 74 with diameters of D6. The diameters D5 are larger than the diameters D6. The rear portions 72 extend from the rear surface 60 toward the front surface 58. The front portions 74 extend from front surface 58 toward the rear surface 60.

As best shown in FIGS. 3 and 8, contact retention clips 22 have a generally cylindrical configuration with contact receiving openings 76 extending lengthwise therethrough. Resilient contact retention arms 78 are provided on the contact retention clips 22 and extend into contact receiving openings 76 to engage and maintain contacts 24 therein. The contact retention clips 22 are dimensioned to receive the contacts 24 therein and to be inserted into the rear portions of the contact-receiving openings 62 of the front insert 18. As the operation of the contact retention clips 22 with the contact 24 is known, a further explanation will not be provided.

The front insert 18, rear insert 20 and contact retention clips 22 for an insert assembly. In the embodiment shown, the insert assembly is inserted into a shell 12, however in other embodiments, the insert assembly may be used with other types of electrical connectors.

During assembly, the front insert 18 is inserted through the wire-receiving face 14 of the shell 12 into opening 28. During insertion, the alignment projection receiving recess 66 of the front insert 18 cooperates with the alignment projection 42 of the shell 12 to properly align the front insert 18 in the shell 12. The insertion of the front insert 18 from the wire-receiving face 14 toward the mating connector-receiving face 16 continues until the stop surface 69 of the front insert 18 engages the stop shoulder 34 of the shell 12. As this occurs, the continued insertion of the front insert 18 toward the mating connector-receiving face 16 is prevented. In this position, the crush ribs 70 are partially deformed: to conform to and engage a portion of the wall of the front portion 32 of the opening 28; and to conform to and engage the stop shoulder 34, to provide an interference or frictional fit between the front insert 18 and the shell 12 to prevent unwanted movement of the insert 18 relative to the shell.

With the front insert 18 properly positioned in the shell 12, the contact retention clips 22 are inserted into the rear portions 72 of the contact-receiving openings 62 of the front insert 18. Alternatively, the contact retention clips 22 may be inserted into the rear portions 72 of the contact-receiving openings 62 of the front insert 18 prior to the insertion of the front insert 18 into the opening 28 of the shell 12.

With the front insert 18 properly positioned in the shell 12, and the contact retention clips 22 properly positioned in the front insert 18, the rear insert 20 is inserted through the wire-receiving face 14 of the shell 12 into opening 28. During insertion, the alignment projection receiving recess 52 of the rear insert cooperates with the alignment projection 42 of the shell 12 to properly align the rear insert 20 in the shell 12 relative to the front insert 18. The diameter D1 of the rear portion 30 of the opening 28 is smaller than the diameter D7 of the rear insert 20 as measured between oppositely facing latches 54. Consequently, as the rear insert 20 is moved toward the mating connector-receiving face 16, the latches 54 of the rear insert 20 engage the wall of the rear portion 30 of the opening 28, causing the latches to be resiliently deformed inward, into the contact-receiving openings 48.

The insertion of the rear insert 20 from the wire-receiving face 14 toward the mating connector-receiving face 16 continues until the front surface 44 of the rear insert 20 engages the rear surface 60 of the front insert 18. As this occurs, the continued insertion of the rear insert 20 toward the mating connector-receiving face 16 is prevented. In this position, the latches 54 are moved into alignment with the second or latching recess 38 of the rear portion 30 of the opening 28, allowing the latches 54 to resiliently return toward their unstressed position (as shown in FIG. 8). In this position, the latches 54 are positioned in the second or latching recess 38, with the latching shoulders 56 of the latches 54 positioned proximate to or abutting the latching shoulder 40 of the second or latching recess 38, positioning the rear insert 20 is a locked position. The cooperation of the latching shoulders 56 of the latches 54 with the latching shoulder 40 of the second or latching recess 38 provides a robust and permanent engagement which cannot be overcome without the destruction of the rear insert 20 or the shell 12.

With the latches 54 of the rear insert 20 properly positioned in the latching recess 38 of the shell 12, the front surface 44 of the rear insert and the rear surface 60 of the front insert 18 are provided in engagement. As the diameter D4 of the contact-receiving openings 48 at the front surface 44 of the rear insert 20 are smaller than the diameter of the contact-receiving openings 62 of the rear surface 60 of the front insert 18, and as the diameter D4 of the contact-receiving openings 48 at the front surface 44 of the rear insert 20 are smaller than the diameter of the contact retention clips 22, the positioning of the rear insert 20 in the locked position, secures and maintains the contact retention clips 22 in the rear portions 72 of the contact-receiving openings 62 of the front insert 18.

The cooperation of the latches 54 of the rear insert 20 and the second or latching recess 38 of the shell 12 and the cooperation of the stop surface 69 and crush ribs 70 of the front insert 18 with the stop shoulder 34 of the shell 12 provides a secure and permanent connection to the shell 12, thereby maintaining the contact retention clips 22 and contacts 24 therein. This eliminates the need to provide adhesive between the rear insert, the front insert and the shell of the connector as is known in the art. In addition, the use of latches 54 which are integral with and a portion of the outer surface 50 eliminate additional parts and allow the rear insert 20 and the connector 10 to made smaller.

As the latches 54 are integral with the outer wall 50 and deflect into the contact-receiving openings 48, the rear insert 20 is durable and cost effective to produce. The strength of the latches 54 also prevents the removal of the rear insert 20 from the shell 12 once the rear insert 20 is moved to the locked position.

In addition, when fully assembled, the axial movement of the rear insert 20 and the front insert 18 is prevented by the compression of the crush ribs 70 and the interference fit of the latches 54, thereby creating a reliable retention without the need for adhesive.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector with an insert assembly used to retain contact in an electrical connector, the insert assembly comprising:

a rear insert comprising:

a rear insert front surface, a rear insert rear surface and a rear insert outer surface, the rear insert outer surface extends between the rear insert front surface and the rear insert rear surface;

rear insert contact-receiving openings extending from the rear insert front surface to the rear insert rear surface;

latches provided in the rear insert outer surface, the latches are provided in alignment with respective rear insert contact-receiving openings of the rear insert contact-receiving openings, the latches are integrally formed in the rear insert outer surface;

wherein the latches are positioned proximate to the rear insert contact-receiving openings thereby allowing the latches to deform into the rear insert contact-receiving openings;

a front insert comprising:

a front insert front surface, a front insert rear surface and a front insert outer surface, the front insert outer surface extends between the front insert front surface and the front insert rear surface;

front insert contact-receiving openings extending from the front insert front surface to the front insert rear surface;

contact retention clips positioned in the front insert contact-receiving openings.

2. The electrical connector as recited in claim 1, wherein the rear insert contact-receiving openings are tapered, such that diameters of the rear insert contact-receiving openings proximate the rear insert rear surface face are larger than diameters of the rear insert contact-receiving openings proximate the rear insert front surface.

3. The electrical connector as recited in claim 1, wherein a rear insert alignment projection receiving recess is provided in the rear insert outer surface, the rear insert alignment projection receiving recess extends between the rear insert front surface and the rear insert rear surface and is dimensioned to receive an alignment projection of a housing of the electrical connector.

4. The electrical connector as recited in claim 3, wherein a front insert alignment projection receiving recess is provided in the front insert outer surface, the front insert alignment projection receiving recess extends between the front insert front surface and the front insert rear surface and is dimensioned to receive the alignment projection of the electrical connector.

5. The electrical connector as recited in claim 1, wherein a respective latch of the latches is provided in alignment with each respective rear insert contact-receiving openings of the rear insert contact-receiving openings.

6. The electrical connector as recited in claim 1, wherein the latches are wider proximate the rear insert rear surface and narrower proximate the rear insert front surface.

7. The electrical connector as recited in claim 2, wherein a thickness of the latches proximate the rear insert rear surface is equal to a thickness of the latches proximate the rear insert front surface.

8. The electrical connector as recited in claim 1, wherein spring rates of the latches can be varied by controlling thickness of the latches and heights that the latches extend from the rear insert outside surface.

9. The electrical connector as recited in claim 1, wherein the latches form latching shoulders at the rear insert rear surface, the latching shoulders are integral with and flush with the rear insert rear surface.

10. The electrical connector as recited in claim 1, wherein a circumferentially extending recess is provided in the front insert outer surface, the recess extends from the front insert front surface toward the front insert rear surface, a wall of the recess acts as a stop surface.

11. The electrical connector as recited in claim 10, wherein crush ribs are provided in the recess.

12. The electrical connector as recited in claim 11, wherein a respective crush rib of the crush ribs is provided in alignment with each respective front insert contact-receiving opening of the front insert contact-receiving openings.

13. The electrical connector as recited in claim 11, wherein the crush ribs are tapered, with a portion of the crush ribs positioned proximate the front insert front surface being thinner than a portion of the crush ribs spaced from the front insert front surface.

14. The electrical connector as recited in claim 1, wherein the front insert contact-receiving openings have rear portions 72 which have diameters which are larger than diameters of front portions of the front insert contact-receiving openings.

15. The electrical connector as recited in claim 14, wherein the contact retention clips are positioned in the rear portions of the front insert contact-receiving openings, the contact retention clips have a generally cylindrical configuration with contact receiving openings extending lengthwise therethrough, resilient contact retention arms are provided on the contact retention clips and extend into contact receiving openings.

16. An electrical connector with an insert assembly used to retain contact in an electrical connector, the insert assembly comprising:

a rear insert comprising:

a rear insert front surface, a rear insert rear surface and a rear insert outer surface, the rear insert outer surface extends between the rear insert front surface and the rear insert rear surface;

rear insert contact-receiving openings extending from the rear insert front surface to the rear insert rear surface;

latches provided in the rear insert outer surface, the latches are provided in alignment with respective rear insert contact-receiving openings of the rear insert contact-receiving openings, the latches are integrally formed in the rear insert outer surface;

wherein the latches are positioned proximate to the rear insert contact-receiving openings thereby allowing the latches to deform into the rear insert contact-receiving openings;

a front insert comprising:

a front insert front surface, a front insert rear surface and a front insert outer surface, the front insert outer surface extends between the front insert front surface and the front insert rear surface;

front insert contact-receiving openings extending from the front insert front surface to the front insert rear surface;

a circumferentially extending recess provide in the front insert outer surface, the recess extends from the front insert front surface toward the front insert rear surface, a wall of the recess acts as a stop surface;

crush ribs provided in the recess.

17. The electrical connector as recited in claim 16, wherein the latches are wider proximate the rear insert rear surface and narrower proximate the rear insert front surface.

18. The electrical connector as recited in claim 17, wherein a thickness of the latches proximate the rear insert rear surface is equal to a thickness of the latches proximate the rear insert front surface.

19. The electrical connector as recited in claim 18, wherein the latches form latching shoulders at the rear insert rear surface, the latching shoulders are integral with and flush with the rear insert rear surface.

20. The electrical connector as recited in claim 19, wherein a respective latch of the latches is provided in alignment with each respective rear insert contact-receiving openings of the rear insert contact-receiving openings.

* * * * *